US010921016B2

(12) United States Patent
Jayarathne et al.

(10) Patent No.: US 10,921,016 B2
(45) Date of Patent: Feb. 16, 2021

(54) INTEGRATED CONTROL BOX FOR HVAC UNITS

(71) Applicant: Johnson Controls Technology Company, Auburn Hills, MI (US)

(72) Inventors: Madhuka M. Jayarathne, Wichita, KS (US); Robert E. Cabrera, Wichita, KS (US); Daniel W. Davis, II, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 45 days.

(21) Appl. No.: 16/259,892

(22) Filed: Jan. 28, 2019

(65) Prior Publication Data

US 2020/0208868 A1 Jul. 2, 2020

Related U.S. Application Data

(60) Provisional application No. 62/787,610, filed on Jan. 2, 2019.

(51) Int. Cl.
*F24F 11/89* (2018.01)
*F24F 13/20* (2006.01)

(52) U.S. Cl.
CPC ..... *F24F 11/89* (2018.01); *F24F 13/20* (2013.01); *F24F 2013/207* (2013.01)

(58) Field of Classification Search
CPC ..... F24F 11/89; F24F 13/20; F24F 2013/207
See application file for complete search history.

(56) References Cited

U.S. PATENT DOCUMENTS

| | | | | |
|---|---|---|---|---|
| 5,064,088 | A * | 11/1991 | Steffes | A45C 11/20 220/837 |
| 7,290,980 | B2 | 11/2007 | Gatley, Jr. et al. | |
| 10,113,728 | B2 | 10/2018 | Buck et al. | |
| 10,116,127 | B1 | 10/2018 | Lopez-Martinez et al. | |
| 2015/0330659 | A1* | 11/2015 | West | F24F 11/89 236/1 C |

FOREIGN PATENT DOCUMENTS

KR 20030055725 7/2003

* cited by examiner

*Primary Examiner* — Marc E Norman
(74) *Attorney, Agent, or Firm* — Fletcher Yoder, P.C.

(57) ABSTRACT

The present disclosure relates to a control box configured to connect to heating, ventilation, and/or air conditioning (HVAC) equipment. The control box includes an outer housing and a divider wall located within the outer housing that separates a high voltage section of the control box and a low voltage section of the control box. The control box also includes a controller disposed within the low voltage section and first wiring extending from the controller to the HVAC equipment via a first passage formed in the outer housing. Additionally, the control box includes second wiring extending between the low voltage section and the high voltage section via a second passage formed in the divider wall. Furthermore, the control box includes a cover configured to engage the outer housing to cover the low voltage section while exposing the high voltage section.

23 Claims, 11 Drawing Sheets

INTEGRATED CONTROL BOX FOR HVAC UNITS

CROSS REFERENCE TO RELATED APPLICATIONS

This application claims priority from and the benefit of U.S. Provisional Application Ser. No. 62/787,610, entitled "INTEGRATED CONTROL BOX FOR HVAC UNITS," filed Jan. 2, 2019, which is hereby incorporated by reference in its entirety for all purposes.

BACKGROUND

The present disclosure relates generally to heating, ventilation, and/or air conditioning (HVAC) systems and, more specifically, to a control box that includes control circuitry used to control of an HVAC unit in an HVAC system.

A wide range of applications exist for HVAC systems. For example, residential, light commercial, commercial, and industrial HVAC systems are used to control temperatures and air quality in residences and other buildings. Certain HVAC units can be dedicated to either heating or cooling, although many HVAC units are capable of performing both functions. HVAC units may also provide ventilation to a conditioned interior space. In general, HVAC systems operate by implementing a thermodynamic cycle in which a refrigerant undergoes alternating phase changes to remove heat from or deliver heat to a conditioned interior space of a building. Heating may also be provided by heat pumps, gas furnace heat exchangers, electric resistance heat, or steam or hot water coils. Similar systems are used for vehicle cooling, and as well as for other types of general refrigeration, such as refrigerators, freezers, and chillers.

In some cases, air conditioning and/or heating systems may include HVAC units with control circuitry that control operation of a corresponding HVAC unit. In some cases, the control circuitry may be included in a portion of the HVAC that is generally accessible to a technician installing or servicing the HVAC unit. However, wiring associated with the control circuitry may be rather complex, which can increase the difficulty associated with performing work on the HVAC unit.

SUMMARY

The present disclosure relates to a control box configured to connect to heating, ventilation, and/or air conditioning (HVAC) equipment. The control box includes an outer housing and a divider wall located within the outer housing that separates a high voltage section of the control box and a low voltage section of the control box. The control box also includes a controller disposed within the low voltage section and first wiring extending from the controller to the HVAC equipment via a first passage formed in the outer housing. Additionally, the control box includes second wiring extending between the low voltage section and the high voltage section via a second passage formed in the divider wall. Furthermore, the control box includes a cover configured to engage the outer housing to cover the low voltage section while exposing the high voltage section.

The present disclosure also relates to a control box configured to be integrated in a heating, ventilation, and/or air conditioning (HVAC) unit. The control box includes an outer boundary and a divider wall within the outer boundary that separates a high voltage section of the control box and a low voltage section of the control box. Additionally, the control box includes a controller disposed within the low voltage section and a first passage formed in the outer boundary to enable first wiring to extend from the controller to equipment external from the outer boundary via the first passage. Moreover, the control box includes a second passage formed in the divider wall to enable second wiring to extend from the low voltage section of the control box to the high voltage section via the second passage. Furthermore, the control box includes a cover configured to cover the low voltage section of the control box while exposing the high voltage section of the control box.

The present disclosure further relates to a heating, ventilation, and/or air conditioning (HVAC) system including HVAC equipment configured to operate to output temperature-controlled air and including a control box. The control box includes an outer boundary that has a plurality of walls, a divider wall that separates a high voltage section of the control box and a low voltage section of the control box, and a controller disposed within the low voltage section. The control box also includes first wiring extending from the controller in the low voltage section to the HVAC equipment to enable the controller to control operation of the HVAC equipment. Additionally, the control box includes second wiring extending between the low voltage section and the high voltage section. The second wiring is configured to be electrically coupled to a power source that outputs higher voltage electrical power to enable supply of electrical power to the controller via the high voltage section. Moreover, the control box includes a transformer coupled to the second wiring and configured to receive the higher voltage electrical power output by the power source and output lower voltage electrical power to the controller using the higher voltage electrical power. Furthermore, the control box includes a cover configured to cover the low voltage section while exposing the high voltage section.

DETAILED DESCRIPTION

The present disclosure is generally directed to a control box that includes multiple sections, which are separated via one or more divider walls. Control circuitry, such as a control panel, may be included within one section of the control box. The section of the control box that includes the control circuitry may be covered by a cover that can be coupled to the divider wall, while another section remains exposed. By leaving a section of the control box exposed, technicians may readily access components of the exposed section, such as wiring, and perform installation or maintenance work involving the HVAC unit in an efficient manner. Moreover, because the section that includes the control panel is covered, it is less likely that improper electrical connections be made to the control panel.

Figure 1:
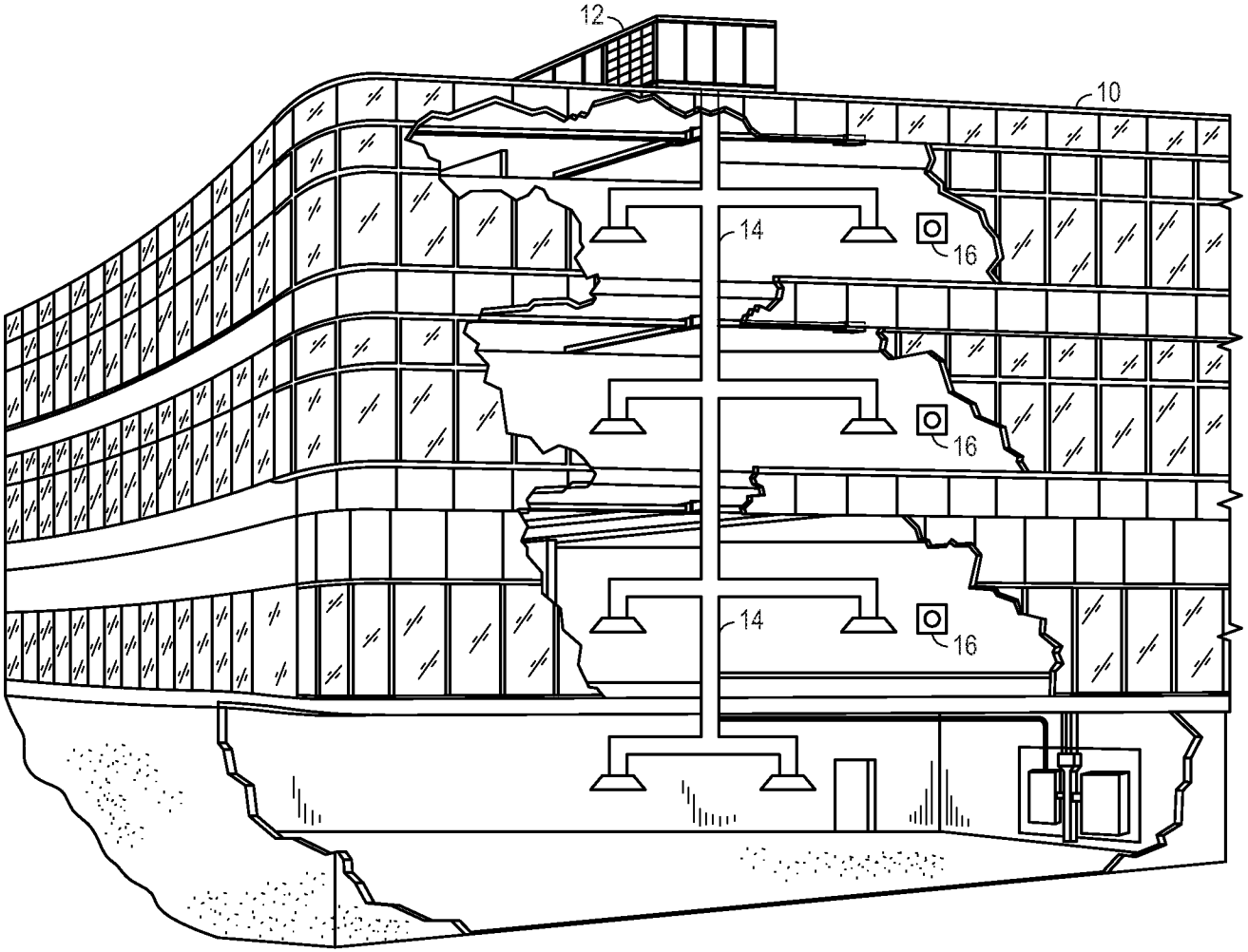
FIG. 1 is a perspective view of an example of a heating, ventilation, and/or air conditioning (HVAC) system for building environmental management, in accordance with aspects of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other HVAC equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
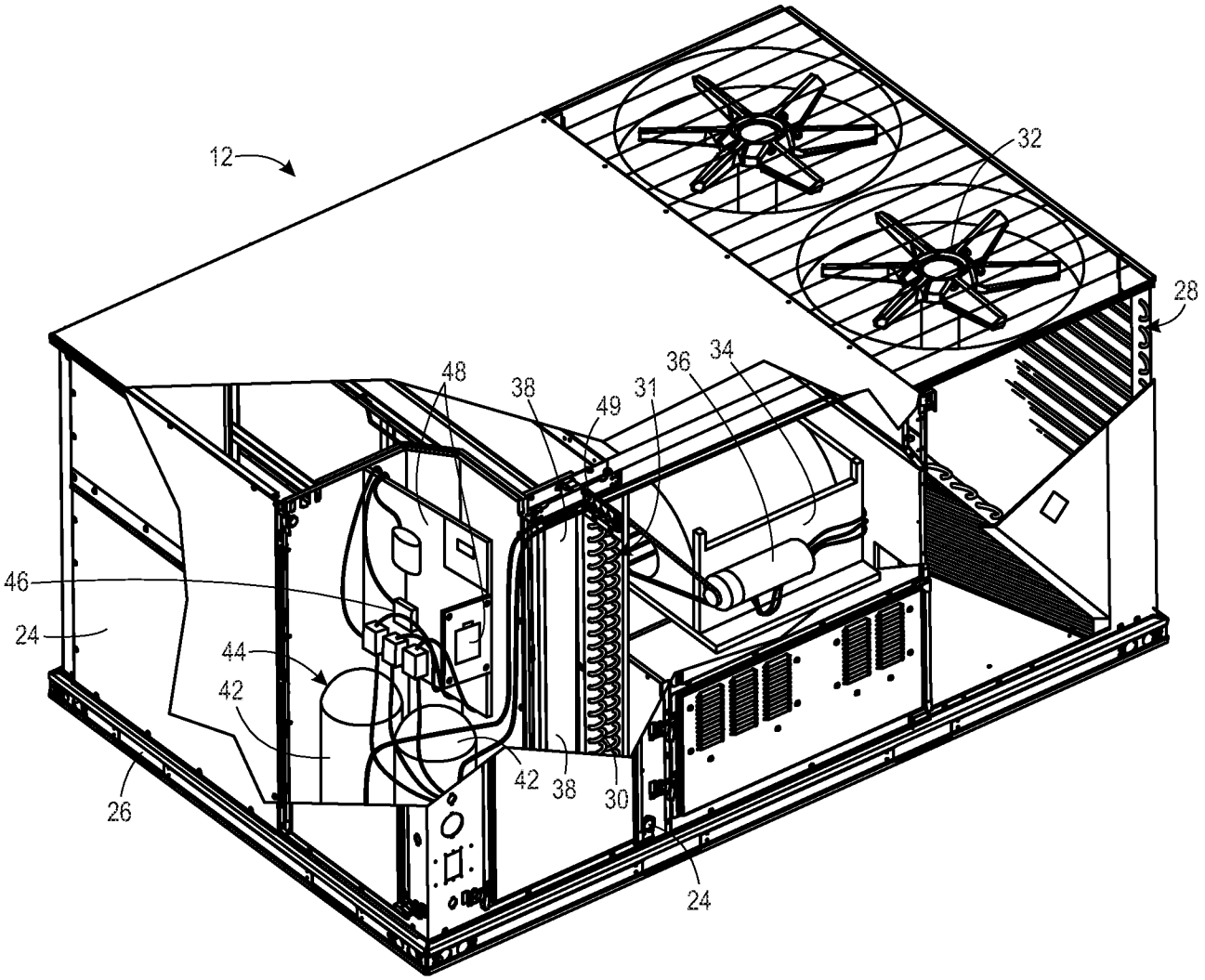
FIG. 2 is a perspective view of an example of a packaged HVAC unit, in accordance with aspects of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other HVAC equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional HVAC equipment and/or devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
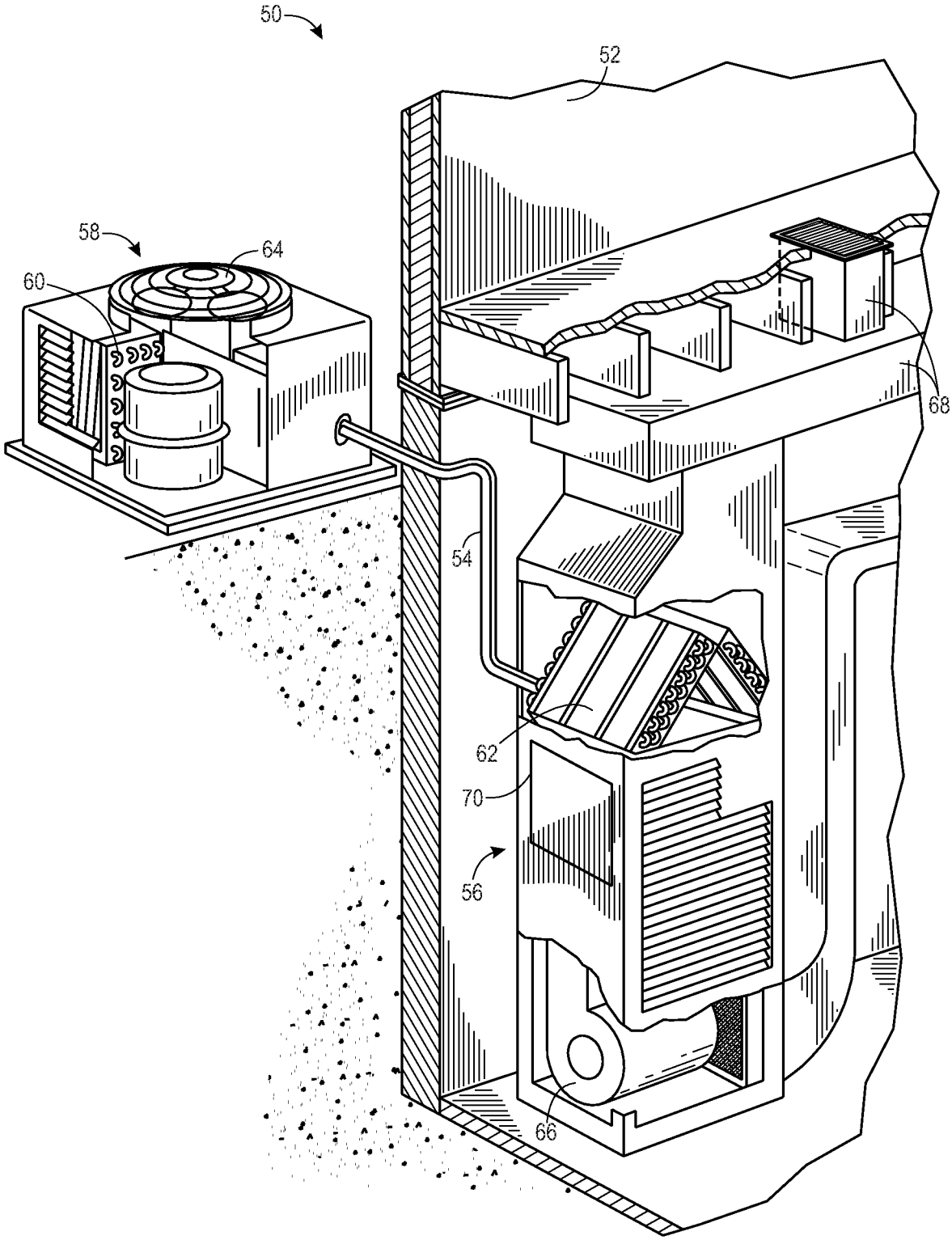
FIG. 3 is a perspective view of an example of a split, residential HVAC system, in accordance with aspects of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
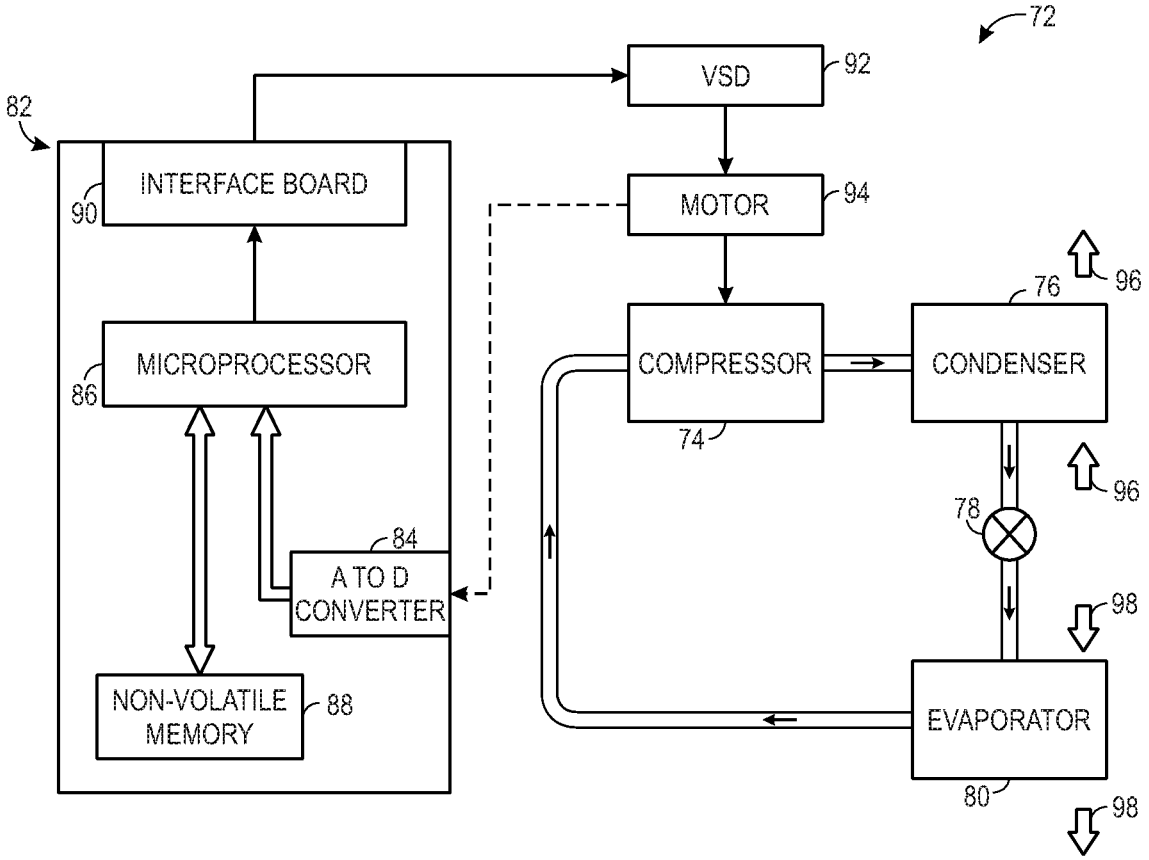
FIG. 4 is a schematic diagram of an example of a vapor compression system that may be used in the HVAC systems of FIGS. 2 and 3, in accordance with aspects of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, in some embodiments, an HVAC unit in an HVAC system may include an integrated control box, for example, included within the HVAC unit to control operation of the HVAC unit. In some embodiments, the control box may include a divider that separates an interior portion of the control box into multiple (e.g., two or more) sections, for example, one of which may include a control panel and/or other circuitry utilized to facilitate controlling operation of the HVAC unit and/or the HVAC system. As an illustrative example, the control panel may be included within a relatively lower voltage section that is located on one side of the divider while a relatively higher voltage section may be located on an opposite side of the divider. The control box may also include a cover that may cover just the relatively lower voltage section or both the relatively lower voltage section and the relatively higher voltage section. Moreover, the divider may include a hole through which wiring from the control panel may pass from the relatively lower voltage section into the relatively higher voltage section. In some cases, the relatively higher voltage section may be left exposed or easily accessible via a movable portion of the cover. For instance, during installation of an HVAC unit that includes the control box discussed herein, the wiring may be connected to a power source while the cover blocks user access to the control panel. Accordingly, the techniques disclosed provide a control box that has a covered (e.g., low voltage) section, which includes a control panel, and an uncovered (e.g., high voltage) section, which leaves wiring to be connected to a power source readily accessible.

Figure 5:
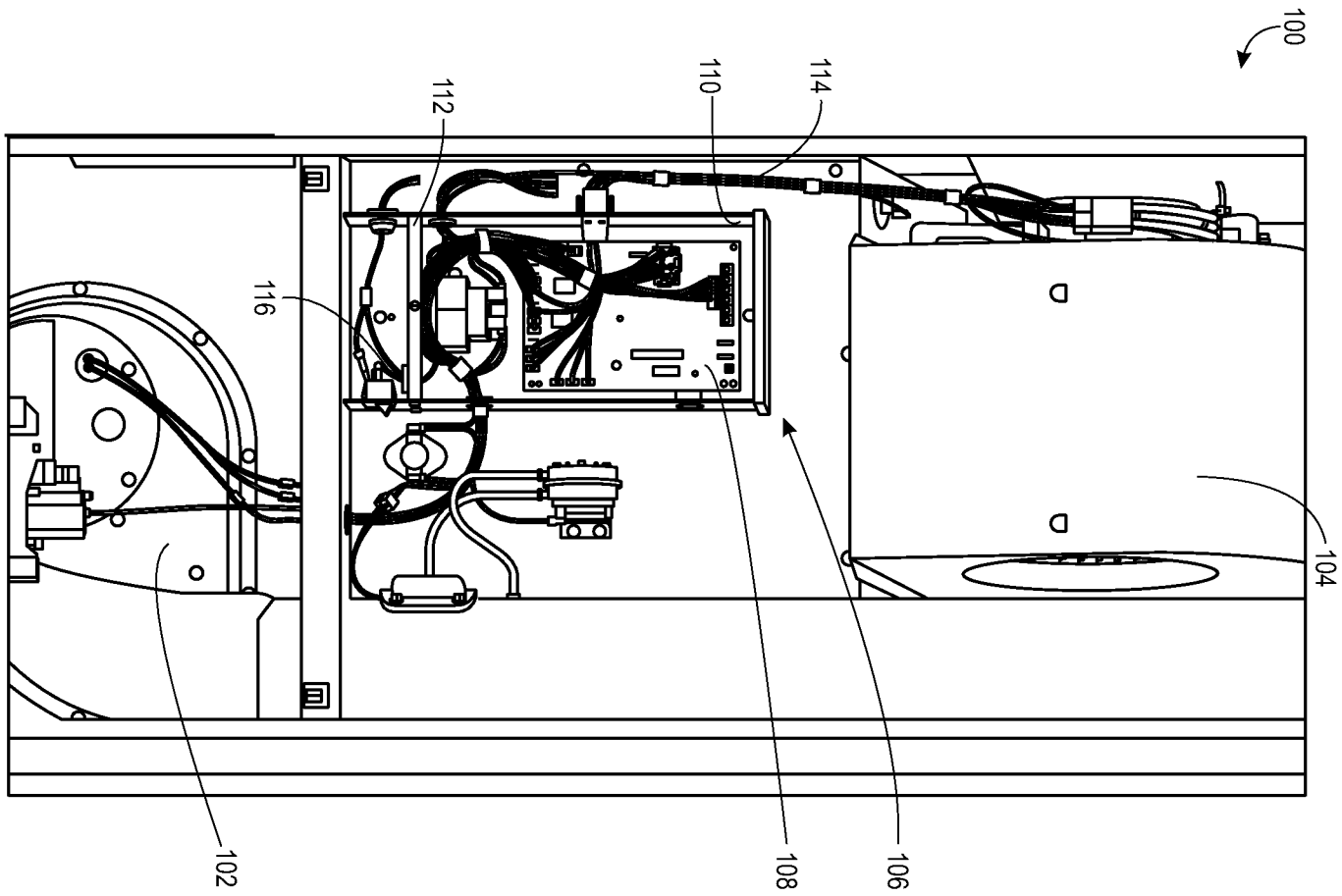
FIG. 5 is a perspective view of an example of an HVAC unit that includes an integrated control box, in accordance with aspects of the present disclosure.

To help illustrate, FIG. 5 shows a perspective view of an HVAC unit 100 that includes an integrated control box 106 and climate control equipment—namely a furnace system 102 and an air handler 104. In some embodiments, the HVAC unit 100 may be the indoor unit 56 of FIG. 3, which may be included in a split HVAC system that may be utilized to provide conditioned air to a residence, such as a house, as discussed above. In other embodiments, the HVAC unit 100 may be an HVAC unit used in a different setting, such as a gas-fired furnace utilized to provide conditioned air to a mobile home. In any case, the furnace system 102 and/or the air handler 104 may operate to provide conditioned air to a conditioned space, such as a house or mobile home.

The control box 106 may include control circuitry that is used to control operation of components (e.g., equipment or devices) in the HVAC unit 100, such as the furnace system 102 and/or the air handler 104. For instance, the control box 106 may include a control panel 108 with control circuitry (e.g., implemented using one or more controllers) communicatively coupled to the furnace system 102 and/or the air handler 104. As depicted, the control box 106 includes an outer boundary (e.g., housing) 110 as well as a divider wall 112 that separates an interior of the control box 106 into multiple (e.g., two) sections, which are discussed in more detail below with respect to FIG. 6. As also elaborated upon below, wiring, such as a first wiring 114 and/or a second wiring 116 may be at least partially included within the control box 106. For instance, the first wiring 114 may extend from the air handler 104 to the control panel 108 and the second wiring 116 may be included within the control box 106. Additionally or alternatively, the second wiring 116 may be coupled to a power source to provide electrical power to the control panel 108.

Figure 6:
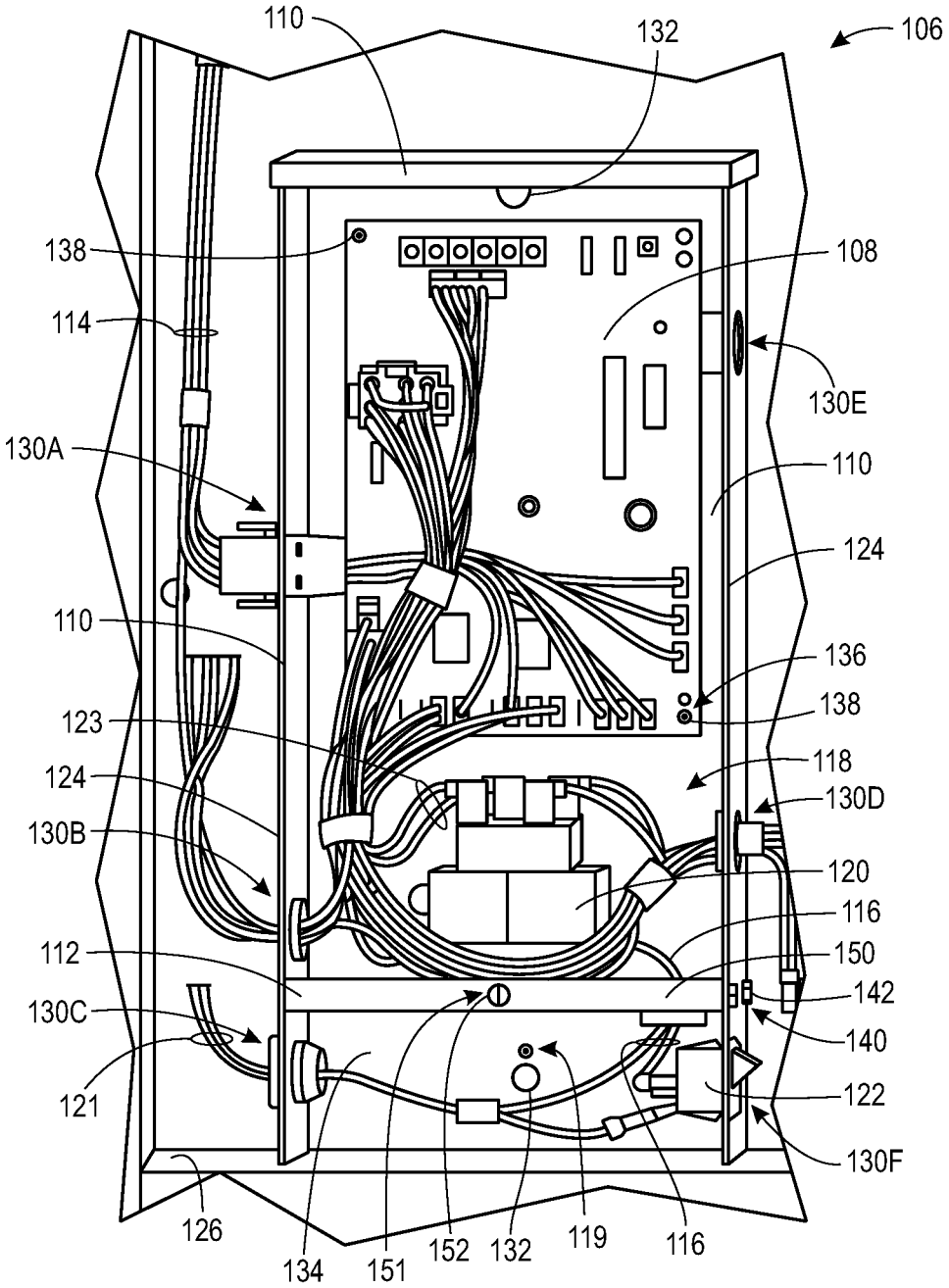
FIG. 6 is a perspective view of an example of the integrated control box of FIG. 5 including a housing and a divider, in accordance with aspects of the present disclosure.

Keeping the discussion of FIG. 5 in mind, FIG. 6 shows a perspective view of an example of the control box 106. As illustrated, the control box 106 includes the control panel 108 and the divider wall 112. More specifically, the control panel 108 may be included within a low voltage section 118 of the control box 106 that is separated from a high voltage section 119 of the control box by the divider wall 112. Generally speaking, while the low voltage section 118 refers to the section that is positioned within the control box 106 above the divider wall 112, electricity within the low voltage section 118 has a voltage that is relatively lower than the voltage of electricity supplied to the high voltage section 119. For instance, the control panel 108 may be supplied with electrical power having 24 volts (e.g., first voltage domain), while the high voltage section 119 may be supplied with electrical power having higher voltages, such as 110 volts, 220 volts, or voltages greater than 220 volts (e.g., second or different voltage domain). For example, electrical power may be supplied from a power source that may be coupled to the second wiring 116, for example, during installation of the HVAC unit 100. A transformer 120 may be coupled to the second wiring 116 and the control panel 108, reduce the voltage of the electricity supplied by the power source, and provide electricity at the decreased voltage to the control panel 108. In some cases, other wiring, such as wiring 121 may be coupled to the second wiring 116 to provide electrical power. More specifically, a portion of the wiring 121 may include wiring from the second wiring 116, and another portion of the wiring 121 may extend from a power source to a switch 122, which may operate as a circuit breaker. The second wiring 116, a portion of which may extend from the switch 122, may be coupled to the transformer 120, which may reduce the voltage of the electricity supplied by the power source. Furthermore, other wiring, such as wiring 123 may be coupled to the transformer 120 and the control panel 108 to supply electricity from the transformer 120 to the control panel 108.

Regarding placement of the control box 106 within the HVAC unit 100, the control box 106 may disposed within the HVAC unit 106 such that walls 124, which form the outer boundary 110 of the control box 106, are positioned on top of a surface or ledge 126 of the HVAC unit 100. In other words, in some embodiments, the outer boundary 110 of the control box 106 alone may not form a fully enclosed structure. However, in other embodiments, the outer boundary 110 of the control box 106 may form a fully enclosed structure. For instance, the outer boundary 110 may include four walls 124 that form a rectangular-shaped outer boundary 110 that alone defines the interior of the control box 106.

Additionally, as depicted, the control box 106 includes several passages or openings 130 through which wiring, such as the first wiring 114 may pass. For instance, openings 130*a*, 130*b*, 130*c*, 130*d*, and 130*e* may enable wiring to enter the control box 106 from outside of the control box 106. The switch 122 may also be positioned in another opening 130*f*.

Figure 7:
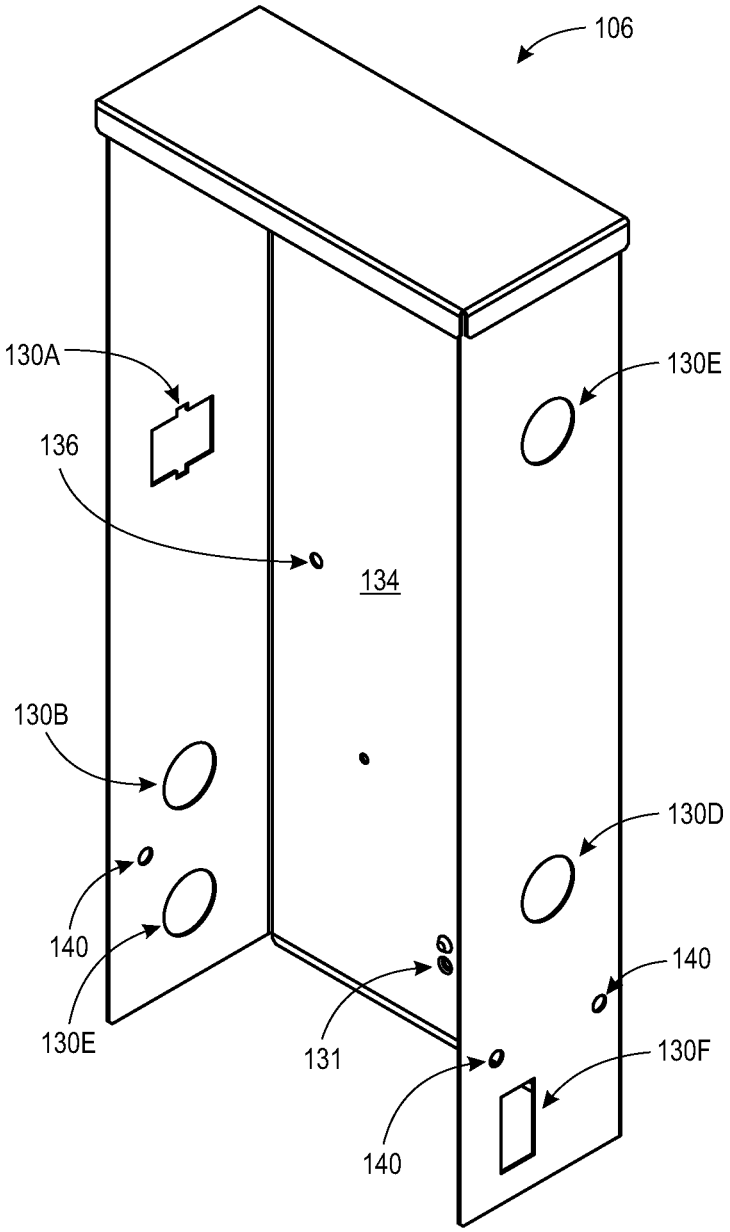
FIG. 7 is perspective view of an example of the housing of the integrated control box of FIG. 5, in accordance with aspects of the present disclosure.

Continuing with the discussion of the openings 130 of the control box 106, FIG. 7 shows a perspective view of an example of the outer boundary 110 of the control box 106. Referring to both FIG. 6 and FIG. 7, it should be noted that, in addition to the openings 130 discussed above, the control box 106 may include other openings, such as opening 131, through which the mechanical fasteners 132, such as screws or bolts, may extend through a back surface 134 of the control box 106 to couple to the control box 106 to the HVAC unit 100 and/or to secure the control box 106 in place within the HVAC unit 100. Moreover, the back surface 134 may include openings, such as opening 136, through which fasteners 138 may extend to couple the control panel 108 to the back surface 134 of the control box 106. Additionally, the control box 106 may include openings 140 through which fasteners 142 may extend to couple the divider wall 112 to the control box 106.

Figure 8:
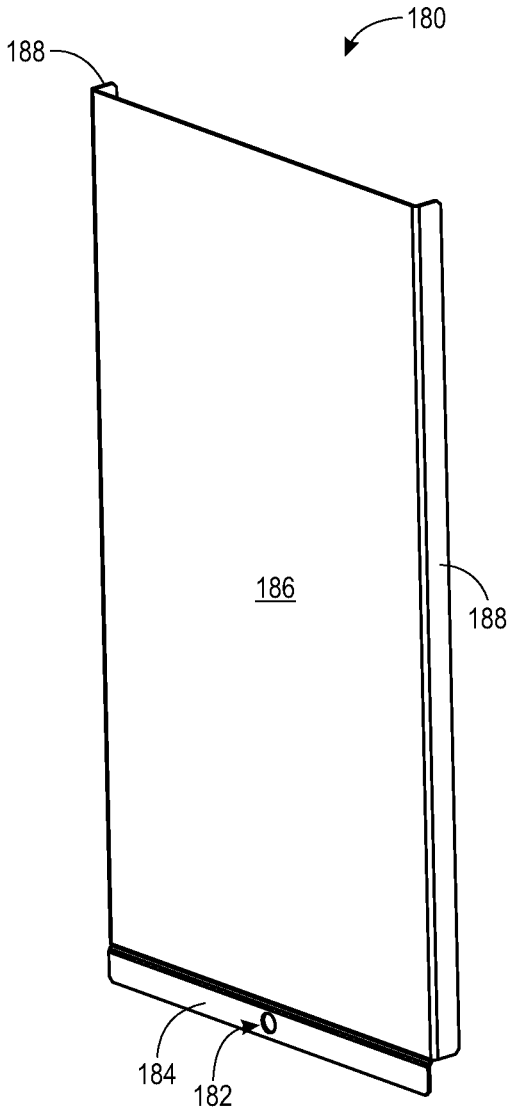
FIG. 8 is a perspective view of an example of the divider of the integrated control box of FIG. 5, in accordance with aspects of the present disclosure.

Returning briefly to FIG. 6, the divider wall 112 includes a vertical surface 150 with an opening 151 through which a fastener 152 may extend. The fastener 152 may also extend through a cover of the control box 106 to couple the cover to the divider wall 112. To help illustrate, FIG. 8 shows a perspective view of an example of a cover 180 that may be coupled to a divider wall 112 via a fastener 152 that extends through an opening 182 of a lower flange 184 of the cover 180 as well as an opening in the vertical surface 150 of the divider wall 112. More specifically, the lower flange 184 may extend from a main panel or face 186 of the cover 180 and align with the divider wall 112 when the cover 180 is coupled to the divider wall 112. Furthermore, the cover 180 may include side flanges 188 that fit over the walls 124 of the control box 106 such that the main face 186 of the cover 180 rests on top of and/or engages the walls 124 when the cover 180 is coupled to the divider wall 112. As such, when coupled to the divider wall 112, the main face 186 of the cover 180 may cover the low voltage section 118 of the control box 106 while leaving the high voltage section 119 exposed.

In other words, when coupled to the divider wall 112, the cover 180 may block access to the low voltage section 118. That is, access to the low voltage section 118 may be limited while the high voltage section 119 may be more readily accessible. At least in some instances, limiting access to the low voltage section 118 while enabling the high voltage section 119 to be readily accessed by a user, such as a service technician, may facilitate improving installation of the HVAC unit 100, for example, by reducing installation time and/or complexity.

To help illustrate, referring briefly to FIG. 6, the second wiring 116 may extend from the low voltage section 118 into the high voltage section 119, meaning the second wiring 116 may be easily accessible to technicians who may be installing the HVAC unit 100. To supply power to the control panel 108 and/or other components that may be included in the control box 106, the second wiring 116 may be coupled to a power source. As such, a technician may access the exposed high voltage section 119 to supply power to the control panel 108 without accessing the low voltage section 118 or the control panel 108 (e.g., by connecting wiring 121 from the power source through an opening 130C in the outer boundary 110 to the switch 132), which may increase the likelihood of the HVAC unit 100 being installed in a manner that enables components (e.g., the control panel 108, the air handler 104, and/or the furnace system 102) to be supplied electrical power in an appropriate (e.g., target or desired) voltage domain (e.g., range).

Figure 9:
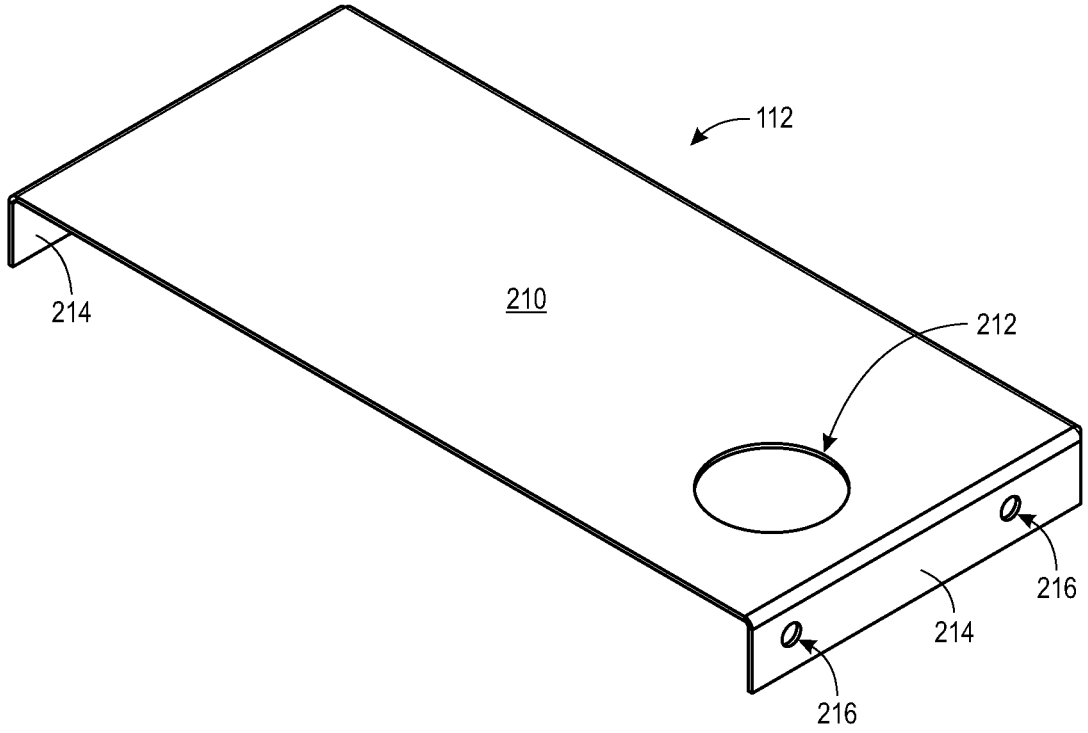
FIG. 9 is a perspective view of example of a cover of the integrated control box of FIG. 5, in accordance with aspects of the present disclosure.

As discussed above, a divider wall 112 may be implemented to separate the low voltage section 118 and the high voltage section 119 of a control box 106 from one another. To help illustrate, an example, of a divider wall 112 that may be implemented in a control box 106 is shown in FIG. 9. As in the depicted example, the divider wall 112 may include a flat surface 210 that is substantially perpendicular and transverse to the vertical surface 150 and from which the vertical surface 150 extends. The flat surface 210, as illustrated, includes an opening 212 that the second wiring 116 may pass through. That is, the second wiring 116 may extend from the low voltage section 118 through the opening 212 and into the high voltage section 119.

Additionally, the divider wall 112 includes two side flanges 214 that extend perpendicularly from, and transversely to, the flat surface 210 and may abut the walls 124 of the control box 106 when the divider wall 112 is installed in the control box 106. More specifically, the divider wall 112 may be coupled to the control box 106 via fasteners that extend through openings 216 of the side flanges 214 and the openings 140 of the walls 124 of the control box 106.

Figure 10:
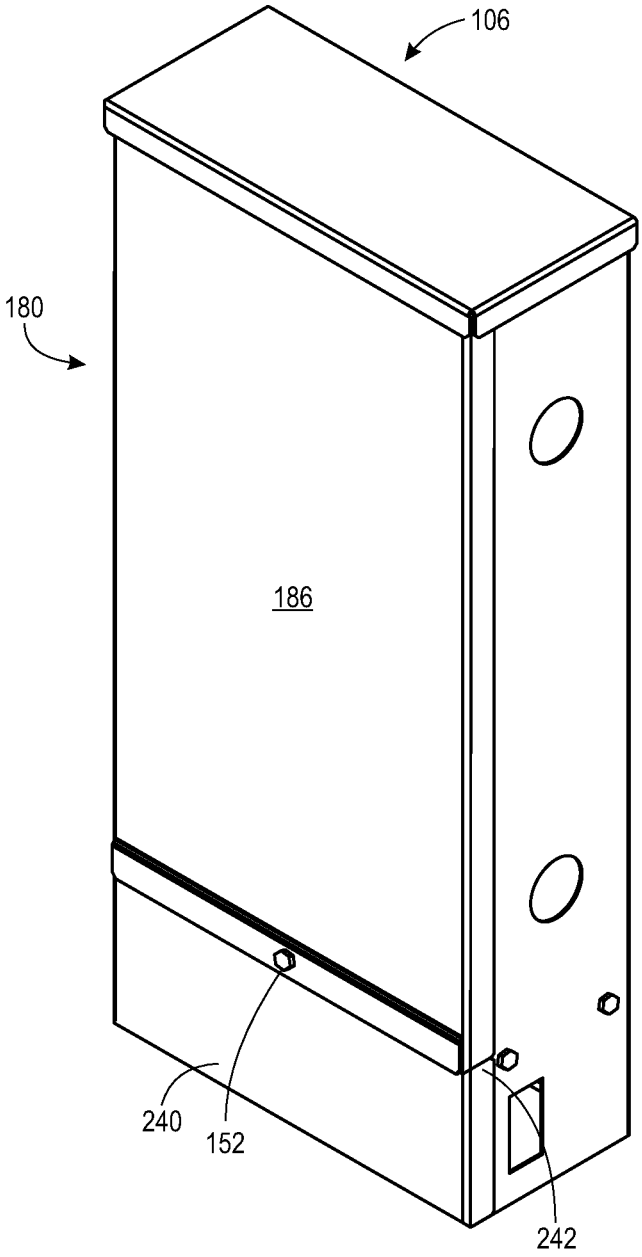
FIG. 10 is a perspective view of an example of the integrated control box of FIG. 5 with the cover of FIG. 9 coupled thereto, in accordance with aspects of the present disclosure.

It should be noted that, in other embodiments, the cover 180 may cover the high voltage section 119 in addition to the low voltage section 118. For example, FIG. 10 is a perspective view of an embodiment of the control box 106 that has an embodiment of the cover 180 that covers both the high voltage section 119 and the low voltage section 118. More specifically, in addition to the main face 186 that covers the low voltage section 118, the illustrated embodiment of the cover 180 includes a lower section or panel 240 that covers that high voltage section 119 of the control box 106. The lower section 240 may include hinges 242 that enable the lower section 240 to rotate with respect to the main face 186 of the cover 180. For example, as illustrated in FIG. 10, the lower section 240 of the cover 180 is in a closed position. However, the lower section 240 may be switched to an open configuration by rotating the lower section 240 with respect to the main face 186. In this manner, access to the low voltage section 118 may still be blocked while the high voltage section 119 remains readily accessible, for instance, by changing the lower face 186 from a closed configuration to an open configuration.

Figure 11:
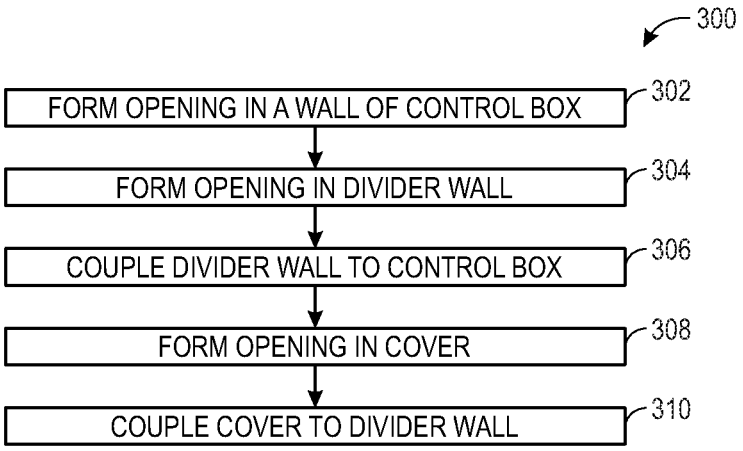
FIG. 11 is a flow diagram of a process for manufacturing the integrated control box of FIG. 5, in accordance with aspects of the present disclosure.

Continuing with the discussion of the drawings, FIG. 11 is a flow diagram of a process 300 for manufacturing a control box 106. While operations of the process 300 are described in one particular order below, it should be noted that the operations of the process 300 may be performed in a different order in other embodiments. Furthermore, in other embodiments, some operations of the process 300 described below may be omitted.

At process block 302, an opening may be formed into a wall 124 of the outer boundary 110 of the control box 106. For example, the opening 130*a* may be formed into the wall 124 of the control box to enable the first wiring 114 to pass between the low voltage section 118 of the control box 106 and an environment external to the control box 106, for example, to enable communicatively coupling the control panel 108 to climate control equipment, such as the air handler 104, and/or the furnace system 102. In some embodiments, at process block 302, several openings may be formed in one or more walls of the control box 106. For example, the openings 130*a*-130*e* and the openings 140 may be formed into the walls 124 of the outer boundary 110 of the control box 106.

At process block 304, one or more openings may be formed in the divider wall 112. For example, the opening 212 may be formed in the flat surface 210 of the divider wall 112. Additionally, the openings 216 may be formed into the side flanges 214 of the divider wall 112. Furthermore, the opening 151 may be formed in the divider wall 112.

At process block 306, the divider wall 112 may be coupled to the control box 106. For example, as described above, the divider wall 112 may be coupled to the control box 106 via fasteners 142 that extend through the openings 140 of the walls 124 of the control box 106 and the openings 216 of the side flanges 214 of the divider wall 112.

At process block 308, an opening may be formed in the cover 180. For instance, the opening 182 may be formed in the lower flange 184 of the cover 180. Moreover, at process block 310, the cover 180 may be coupled to the divider wall 112. For example, the fastener 152 may by placed to extend through the opening 182 of the cover 180 as well as the opening 151 of the divider wall to couple the cover 180 to the divider wall 112.

Figure 12:
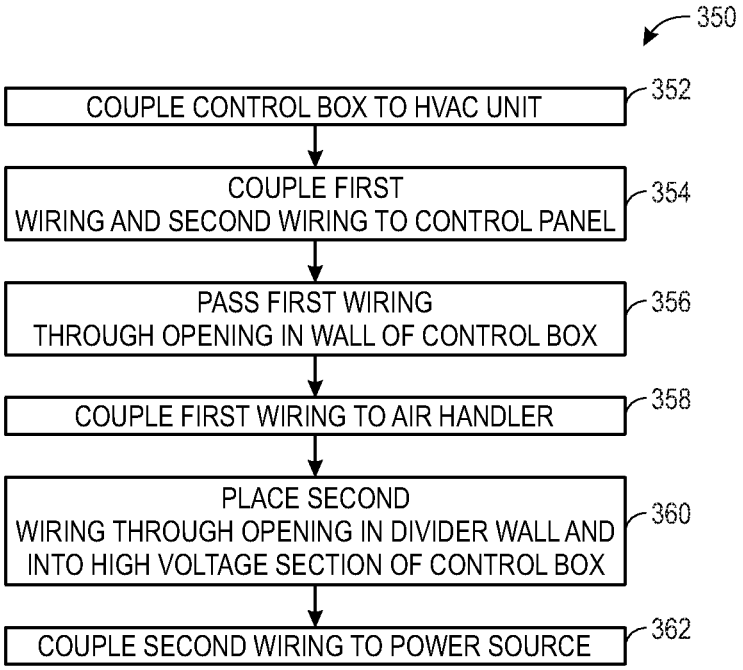
FIG. 12 is a flow diagram of a process for deploying the integrated control box of FIG. 5 in an HVAC system, in accordance with aspects of the present disclosure.

FIG. 12 is a flow diagram of a process 350 for deploying a control box 106 in an HVAC system, such as within the HVAC unit 100. While operations of the process 350 are described in one particular order below, it should be noted that the operations of the process 350 may be performed in a different order in other embodiments. Furthermore, in other embodiments, some operations of the process 350 described below may be omitted.

At process block 352, the control box 106 may be coupled to HVAC equipment, such as the HVAC unit 100. At process block 354, the first wiring 114 and the second wiring 116 may be coupled to the control panel 108 of the control box 106. For example, individual wires included in the first wiring 114 and the second wiring 116 may be coupled to corresponding portions of the control panel 108. In other embodiments, the second wiring 116 or a portion thereof may be coupled to the transformer 120 or the switch 122 instead of the control panel 108.

At process block 356, the first wiring 114 may be passed through an opening in the wall 124 of the control box 106. For instance, the first wiring 114 may be placed through the opening 130*a*, which may leave a portion of the first wiring 114 disposed outside of the control box 106. Additionally, at process block 358, the first wiring may be coupled to HVAC equipment, such as the HVAC unit 100 and/or an air handler 104 of the HVAC unit 100.

At process block 360, the second wiring 116 may be placed through the opening 212 of the divider wall 112 and into the high voltage section 119 of the control box 106. Furthermore, at process block 362, the second wiring 116 may be coupled to a power source. For example, the second wiring 116 may be passed through the opening 130*c* in the wall 124 of the control box 106 and coupled to a source of electrical power.

Accordingly, the present disclosure is directed to an HVAC unit that includes a control box that blocks access to one portion of the control box while enabling access to another portion of the control box to enable more efficient and correct installation of the HVAC unit. For example, as discussed above, access to a low voltage section of the control box that includes a control panel that may control operation of components of the HVAC unit may be limited, while the high voltage section of the HVAC unit may be unexposed or otherwise easily accessible.

While only certain features and embodiments of the present disclosure have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A control box configured to connect to heating, ventilation, and/or air conditioning (HVAC) equipment, comprising:

an outer housing;

a divider wall located within the outer housing and separating a high voltage section of the control box and a low voltage section of the control box;

a controller disposed within the low voltage section;

first wiring extending from the controller to the HVAC equipment via a first passage formed in the outer housing to enable the controller to control operation of the HVAC equipment;

second wiring extending between the low voltage section and the high voltage section via a second passage formed in the divider wall to enable supply of electrical power to the controller via the high voltage section; and a cover configured to engage the outer housing to cover the low voltage section while exposing the high voltage section, wherein the cover comprises a main face and a lower flange that extends from the main face, wherein the lower flange is configured to be aligned with the divider wall when the cover is coupled to the divider wall.

2. The control box of claim 1, wherein the main face is configured to engage the outer housing and the divider wall, and the cover comprises a panel engaged with the main face and rotatable with respect to the main face between an open position and a closed position while the main face is engaged with the outer housing and the divider wall, wherein the panel is configured to expose the high voltage section of the control box while in the open position and to cover the high voltage section while in the closed position.

3. The control box of claim 1, wherein the cover is configured to be removably coupled to the outer housing and the divider wall.

4. The control box of claim 1, wherein the divider wall is removably attached to the outer housing of the control box.

5. The control box of claim 1, wherein the cover is configured to be removably coupled to the divider wall by a mechanical fastener that extends through a third passage in the divider wall and a fourth passage in the cover.

6. The control box of claim 1, wherein the control box is integral with a mobile home gas-fired furnace.

7. The control box of claim 6, wherein the controller comprises a gas-fired furnace control panel.

8. The control box of claim 1, wherein the HVAC equipment comprises a furnace system, an air handler, or both.

9. A control box configured to be integrated in a heating, ventilation, and/or air conditioning (HVAC) unit, comprising:

an outer boundary;

a divider wall within the outer boundary that separates a high voltage section of the control box and a low voltage section of the control box;

a controller disposed within the low voltage section;

a first passage formed in the outer boundary to enable first wiring to extend from the controller to equipment external from the outer boundary via the first passage;

a second passage formed in the divider wall to enable second wiring to extend from the low voltage section of the control box to the high voltage section via the second passage; and a cover configured to cover the low voltage section of the control box while exposing the high voltage section of the control box, wherein the divider wall comprises:

a first surface comprising the second passage; and a second surface that extends transversely from the first surface, wherein the cover is configured to be coupled to the second surface.

10. The control box of claim 9, wherein the outer boundary comprises a plurality of walls, wherein the plurality of walls are configured to be disposed on a surface within the HVAC unit.

11. The control box of claim 10, wherein the outer boundary is configured to attach to the HVAC unit to facilitate positioning within and supply of conditioned air to a mobile home.

12. The control box of claim 9, wherein the first wiring is coupled to an air handler, a furnace, or both of the HVAC unit.

13. The control box of claim 9, comprising the second wiring being configured to be electrically coupled to a power source that outputs higher voltage electrical power and a transformer configured to receive the higher voltage electrical power output by the power source and output lower voltage electrical power to the controller using the higher voltage electrical power.

14. The control box of claim 9, wherein:

the outer boundary comprises a plurality of first openings disposed within the outer boundary;

the divider wall comprises a plurality of third surfaces that extend substantially transversely from the first surface of the divider wall, wherein the plurality of third surfaces comprises a plurality of second openings configured to be aligned with the plurality of first openings in the outer boundary; and the divider wall is configured to be coupled to the outer boundary via a plurality of fasteners configured to extend through the plurality of first openings in the outer boundary and the plurality of second openings in the divider wall.

15. The control box of claim 9, wherein the cover comprises:

a first panel configured to engage the outer boundary and the divider wall; and a second panel engaged with and rotatable with respect to the first panel between an open configuration and a closed configuration, wherein the second panel is configured to expose the high voltage section of the control box while in the open configuration and cover the high voltage section while in the closed configuration.

16. The control box of claim 9, comprising a third passage formed in the outer boundary to enable a third wiring to extend from the controller to a furnace system, an air handler, or both of the HVAC unit via the third passage.

17. A heating, ventilation, and/or air conditioning (HVAC) system including HVAC equipment configured to operate to output temperature-controlled air and including a control box, the control box comprising:

a divider wall that separates a high voltage section of the control box and a low voltage section of the control box;

a controller disposed within the low voltage section;

first wiring extending from the controller in the low voltage section to the HVAC equipment to enable the controller to control operation of the HVAC equipment;

second wiring extending between the low voltage section and the high voltage section, wherein the second wiring is configured to be electrically coupled to a power source that outputs higher voltage electrical power to enable supply of electrical power to the controller via the high voltage section;

a transformer coupled to the second wiring and configured to receive the higher voltage electrical power output by the power source and output lower voltage electrical power to the controller using the higher voltage electrical power;

a cover configured to cover the low voltage section while exposing the high voltage section; and a switch disposed in the high voltage section of the control box, wherein at least a portion of the second wiring is coupled to the switch.

18. The HVAC system of claim 17, wherein the cover comprises a main face and a lower flange that extends from the main face, wherein the lower flange is configured to be aligned with the divider wall when the cover is coupled to the divider wall.

19. The HVAC system of claim 18, wherein the cover is configured to be coupled to the divider wall via a fastener that extends through a first opening in the lower flange of the cover and a second opening in the divider wall.

20. The HVAC system of claim 17, wherein the control box comprises an outer boundary comprising a plurality of walls, wherein the plurality of walls comprises a plurality of first openings in a first wall and a second wall of the plurality of walls of the outer boundary.

21. The HVAC system of claim 20, wherein the divider wall is configured to be coupled to the control box via a plurality of fasteners, wherein each of the plurality of fasteners extends through one of the plurality of first openings and one of a plurality of second openings formed in the divider wall.

22. The HVAC system of claim 17, comprising third wiring directly coupled to the transformer and the controller, wherein the third wiring is configured to deliver the lower voltage electrical power to the controller.

23. The HVAC system of claim 22, comprising fourth wiring coupled to the switch in the high voltage section of the control box and configured to be coupled to the power source.

* * * * *